US005755087A

United States Patent [19]

Biller et al.

[11] Patent Number: 5,755,087

[45] Date of Patent: May 26, 1998

[54] OPEN-END ROTOR SPINNING DEVICE

[75] Inventors: Werner Biller, Ingolstadt; Werner Bergmeier, Lenting, both of Germany

[73] Assignee: Rieter Ingolstadt Spinnereimaschinenbau AG, Ingolstadt, Germany

[21] Appl. No.: 792,258

[22] Filed: Jan. 31, 1997

Related U.S. Application Data

[63] Continuation of Ser. No. 450,233, May 25, 1995, abandoned.

[30] Foreign Application Priority Data

Nov. 18, 1994 [DE] Germany ..... 44 41 087.5

[51] Int. Cl.[6] ..... D01H 4/00

[52] U.S. Cl. ..... 57/414; 57/406; 57/407; 57/415; 57/416

[58] Field of Search ..... 57/406, 407, 408, 57/409, 411, 412, 413, 414, 415, 416, 417

[56] References Cited

U.S. PATENT DOCUMENTS

| | | | |
|---|---|---|---|
| 3,126,697 | 3/1964 | Cizek et al. | 57/415 |
| 3,538,698 | 11/1970 | Ripka et al. . | |
| 3,624,995 | 12/1971 | Rajnoha et al. . | |
| 3,651,632 | 3/1972 | Shepherd . | |
| 3,785,138 | 1/1974 | Rajnoha et al. | 57/413 |
| 3,822,541 | 7/1974 | Croasdale et al. . | |
| 3,834,148 | 9/1974 | Sakurai et al. . | |
| 3,918,246 | 11/1975 | Bouhon | 57/412 |
| 3,922,840 | 12/1975 | Watanabe et al. | 57/407 |
| 3,968,636 | 7/1976 | Junek et al. . | |
| 4,014,162 | 3/1977 | Stahlecker . | |
| 4,291,528 | 9/1981 | Miyamoto et al. . | |
| 4,321,788 | 3/1982 | Alston | 57/408 |
| 4,339,910 | 7/1982 | Ali et al. | 57/411 |
| 4,393,648 | 7/1983 | Rambousek et al. . | |
| 4,567,723 | 2/1986 | Safar | 57/413 |
| 4,731,987 | 3/1988 | Jaros et al. | 57/415 |
| 4,769,984 | 9/1988 | Raasch et al. . | |
| 4,879,873 | 11/1989 | Kawabata et al. . | |
| 4,903,474 | 2/1990 | Stahlecker . | |
| 5,065,572 | 11/1991 | Stahlecker . | |
| 5,111,651 | 5/1992 | Pohn et al. . | |
| 5,491,966 | 2/1996 | Billner . | |

FOREIGN PATENT DOCUMENTS

| | | | |
|---|---|---|---|
| 0311988 | 4/1989 | European Pat. Off. . | |
| 2310439 | 9/1973 | Germany . | |
| 2261042 | 6/1974 | Germany . | |
| 2410940 | 9/1974 | Germany . | |
| 3734544C2 | 5/1989 | Germany . | |
| 3815182 | 11/1989 | Germany | 57/414 |
| 4123255A1 | 1/1993 | Germany . | |
| 58-169526 | 10/1983 | Japan . | |
| 1358810 | 7/1974 | United Kingdom . | |
| 1454824 | 11/1976 | United Kingdom . | |
| 2086437 | 5/1982 | United Kingdom | 57/416 |
| 2192010 | 12/1987 | United Kingdom . | |
| 9201097 | 1/1992 | WIPO . | |

*Primary Examiner*—William Stryjewski
*Attorney, Agent, or Firm*—Dority & Manning

[57] ABSTRACT

An open-end spinning device has a spinning rotor defining a fiber collection groove between a rotor bottom and an open-end of the spinning rotor. The rotor further includes a wall extending from the fiber collection groove to the open end of generally less than 6.0 mm. A rotor cover has an extension reaching into the interior of the spinning rotor. The extension includes at least a portion of a fiber feeding channel for feeding a fiber and air mixture into the rotor. A feed surface is disposed essentially parallel to a plane through a fiber collection groove into the extension adjacent the fiber feeding channel so that fibers exiting the feeding channel are directed along the feed surface. The feed surface has a radial dimension so that an open radial distance of less than 4.0 mm exists between the feed surface and the wall or fiber collection groove which is directly radially opposite of the feed surface.

29 Claims, 1 Drawing Sheet

OPEN-END ROTOR SPINNING DEVICE

This is a continuation of application Ser. No. 08/450.233, filed May 25, 1995, which was abandoned upon the filing hereof.

BACKGROUND OF THE INVENTION

The instant application relates to an open-end spinning device as well as to an open-end spinning rotor. DE-A 42 24 687 discloses a process for open-end spinning as well as an open-end spinning device in which the fibers coming out of the fiber feeding channel are first fed on a wall that is perpendicular to the rotor axis, causing them to be placed in a compressed state in the plane of this surface while the conveying air is separated from the fibers, whereupon the fibers are fed on a surface of lower height, as viewed in the direction of the spinning rotor. From there they are incorporated into the forming yarn and are withdrawn from the rotor.

DE-A 41 23 255 discloses an open-end spinning device, the special advantage of which is supposed to be that practically no more fibers go directly into the fiber collection groove of the spinning rotor, but that all are first fed on the gliding wall on which they then glide along, and only then reach the fiber collection groove of the spinning rotor. It is supposed to be possible, with this design, to operate a spinning rotor with a diameter of approx. 30 mm which is described in the application as being extremely small.

In the applications DE-A 42 24 687 and DE-A 41 23 255 it is essential that great importance is given to the fact that the fed fibers are first placed on the gliding wall of the spinning rotor in order to glide for as long a distance as possible on the gliding wall before reaching the fiber collection groove. This gliding is supposed to stretch the fibers so that they are deposited in a stretched condition and parallel in the fiber collection groove.

DE-A 20 16 469 discloses an open-end spinning device very similar in structure to the above-mentioned applications. However, not as much importance is given here to the fibers' reaching the gliding wall of the spinning rotor first, but here it appears to be possible to feed the fibers first to the gliding wall or to let them go directly into the fiber collection groove. For the rest, the object of the DE-A 20 16 469 is to design the open-end spinning device so that if the operation is interrupted, it should be easily possible to remove the fibers. It is merely mentioned also that to withdraw the yarn in a plane which is located below the fiber collection groove is supposed to be advantageous. Nothing is said concerning the different results if the fibers are fed directly into the fiber collection groove or first to the gliding wall and from there into the fiber collection groove.

Following DE-A 20 16 469 the state of the art has moved into a totally different direction. The purpose was, as appears clearly also from the two above-mentioned publicly distributed printed copies of application papers DE-A 41 23 255 and DE-A 42 24 687, to prevent the fed fibers from reaching the fiber collection groove directly. This is because the state of the art was absolutely convinced that it is absolutely necessary for the fed fibers to reach the fiber gliding wall first in order to glide along it into and down into the groove. In this gliding-down action, the state of the art saw the only possibility for the fibers to reach the fiber collection groove from which they are subsequently withdrawn in a stretched state. Despite great efforts in configuring the gliding wall of the spinning rotor with respect to roughness, gliding value, and also wear resistance, the actual problems encountered in fiber orientation in the rotor spinning yarn could not be solved. Although it was attempted to feed the fibers directly into the rotor groove in the device of the DE-A 20 16 469, this is probably not even possible with the shown device (see FIGS. 3 and 4), so that any possible advantage of direct feeding into the fiber collection groove is not clearly demonstrated by this publication. The disadvantage here is that the radial distance between the fiber collection groove and the end of the surface on which the fibers are fed through the fiber feeding channel is so great that the orientation of the fibers is lost once more during their long free flight to the fiber collection groove. This becomes all the more clear if one remembers that at that time rotors with large diameters were used, as at that time high rotor speeds such as are possible today and are indeed used, were still in the distant future. Thus the diameter of the fiber collection groove with these rotors was at least 40 mm and much more, e.g. 65 mm.

Another disadvantage of the open-end spinning devices of the state of the art consists in the fact that the feeding of the fibers directly into the fiber collection groove is prevented due to the fact that a shortening of the distance between the fiber collection groove and the end of the gliding surface is not even possible. This is because the open-end spinning rotors of the state of the art have such a small diameter at their open end, due to the angle and in particular the length of the fiber gliding wall as seen in axial direction, that the diameter of the portion of the cover of the open-end rotor spinning device extending into the spinning rotor must have a much shorter diameter than the fiber collection groove of the spinning rotor. Due to the fact that the rotor cover is swivelled away from the spinning rotor in a swivelling movement with a swivel axis which is perpendicular to the shaft of the spinning rotor and at a distance from same, it is necessary for the portion of the rotor cover extending into the spinning rotor to be even smaller so as not to knock against the edge of the spinning rotor during swivelling. In the devices DE-A 42 24 687 and DE-A 41 23 255 the conditions at the fiber feeding channel and at the output slit for the fibers are very cramped because the portion of the cover extending into the rotor must take into account the very small diameter of the open side of the spinning rotor. With the smaller spinning rotors, e.g. those with a groove diameter of 30 mm and less, this has very unfavorable consequences in the treatment of the fibers, in the withdrawal of the yarn from the open-end spinning rotor, and in the structural design of the rotor cover.

It is another disadvantage of the state of the art that the spinning rotors consume much energy in being driven. This is caused by the gliding wall with its large surface which results in much friction with the surrounding air and the air in the spinning rotor at high rotational speeds over 130,000 rpm's. It is yet another disadvantage that due to this design, the spinning rotors have a great mass which is more difficult to accelerate, require stronger supports, and causes more unbalanced mass.

In the state of the art it is proposed in DE-A 23 01 439, in order to save energy, that the diameter of the fiber collection groove is sized according to a certain ratio of the distance between the fiber collection groove and the edge of the spinning rotor. In the rotors for high rotor speeds of approx. 100,000 and more rpm's known in the past, these dimensions were however considered unusable and could not provide the person schooled in the art with any lesson concerning the design of a spinning rotor. Thus, for example, conventional spinning rotors have a height h, as defined in DE-A 23 01 439, of approximately 10 mm. For the real diameter this would mean that a spinning rotor designed accordingly would have to have a diameter of 70 mm in the area of the fiber collection groove. The lesson of DE-A 23 01 439 cannot be used, as it pertained to spinning rotors with diameter values that were normally used at that time, i.e. much over 45 to 50 mm in diameter in the area of the fiber collection groove. The state of the art has developed differently than taught in DE-A 23 01 439, in the sense that the average height h was selected unchangeable, independently of the diameter of the fiber collection groove, whereby values in the range of 9.5 mm to 11.5 mm were used with fiber groove diameters between 30 mm and approximately 40 mm. In every other respect DE-A 23 01 439 contains no indications at all concerning the feeding of fibers into the spinning rotor, so that this state of the art has provided no suggestions in the development of spinning rotors that could have been used at higher rotational speeds.

OBJECTS AND SUMMARY OF THE INVENTION

It is a principal object of the instant invention to design an open-end spinning device and an open-end spinning rotor wherein the disadvantages of the state of the art are overcome and so that it is possible to feed the fibers in a favorable manner into the open-end spinning rotors thanks to the embodiment of the open-end spinning device according to the invention, so that spinning rotors with diameters of approximately 30 mm and much less may also be used in the future. This has the special advantage that the productivity of open-end rotor spinning can be increased considerably because the production speed of the yarn can be increased considerably with rotors that are especially small.

It is a further object of the instant application to propose an open-end spinning rotor which can be used especially well at high rotational speeds, for example in excess of 130,000 rpm's, and whereby the spinning rotor is operated at the same time with low consumption of drive energy, whereby it should have a lower mass and a good center-of-gravity position, because the center of gravity is shifted closer to the bearing point of the spinning rotor.

Additional objects and advantages of the invention will be set forth in part in the following description, or may be obvious from the description, or may be learned through practice of the invention.

The invention of the instant application is based, among other things, on the recognition of the fact that, contrary to the assumptions of the state of the art, the gliding of the fibers along the wall of the spinning rotor does not substantially lead to the desired result, i.e. that the fibers are incorporated into the yarn in such a manner as to impart a satisfactory structure to same. In particular the so-called belly bandages, i.e. fibers that are wrapped around the yarn instead of being part of the fiber amalgamation, can be neither decreased nor avoided. Through the rotor spinning device according to the invention, the fibers are deposited parallel in the fiber collection groove, as much as possible without gliding along the fiber gliding wall for any length of time. This is because by feeding the fibers on the feed surface sufficiently well parallel to each other, so that when they pass into the fiber collection groove they only need to be stretched through its high circumferential speed. They have already been given their parallel orientation relative to each other by being fed to the feed surface. This favorable orientation is not cancelled out by the now short or completely omitted gliding distance along the wall of the spinning rotor, so that the parallel position of the fibers relative to each other and their orientation are improved. Thus, the fibers arrive into the fiber collection groove with their beginning and their end lying in one and the same plane. Thereby the number of the so-called belly bandages is reduced since fewer yarn beginnings are incorporated into the yarn, for as long as its end is not yet in the fiber collection groove. The design of the open-end spinning device is especially advantageous if the perforation in the extension through which the yarn is drawn off, and where therefore also the yarn draw-off nozzle is located, is in a plane which is closer to the bottom of the rotor than the fiber collection groove itself. Thereby the yarn is withdrawn from the fiber collection groove without coming into contact with the fibers which have not yet been deposited in the fiber collection groove. The open-end spinning device is of an especially favorable design if the feed surface is at a short distance from the wall of the spinning rotor. Thereby the fibers need to bridge only a short distance on which they are not guided by a surface. It is especially favorable for this distance to be especially short, e.g. between 2.8 and 1 mm.

In another advantageous embodiment, the feed surface is inclined relative to the rotor axis so that the fibers are forced into a gliding direction which takes them deeper into the interior of the spinning rotor, so that it is easier to feed the fibers directly into the fiber collection groove. At the same time this makes it possible to let the fiber feeding channel extend less deeply into the spinning rotor. The open-end spinning device according to the invention is of an especially advantageous design if the open-end spinning rotor has a fiber collection groove with a diameter of less than 35 mm. This makes it possible to produce an economically efficient embodiment of the invention. The advantages of the invention come to light especially if the fiber collection groove has a diameter of less than 30.5 mm because the fibers are oriented as desired and are thus deposited in the fiber collection groove without the disadvantages of the state of the art. The design of the open-end spinning device is especially advantageous if it is provided with a spinning rotor which has a shaft for support and/or for drive. Thereby the rotor is easier to replace and can be driven as well as braked just.

In another advantageous embodiment of the invention, the spinning rotor is provided with a storage surface on its side across from the open end, e.g. in form of disks and made of a material capable of being magnetized, so that the spinning rotor can be supported as well as driven through electromagnetic forces. This makes especially high rotational speeds possible. The spinning rotor can advantageously also be provided with openings in its rotor bottom so that a negative pressure is created in the rotor by its rotation, and extra measures for the production of negative pressure can be omitted.

Thanks to the design of the open-end spinning rotor according to the invention, the spinning rotor can be used with special economical efficiency at high rotational speeds. Due to the low height of the wall between fiber collection groove and opening of the spinning rotor its surface is relatively small, which makes it possible to lower its air resistance considerably by comparison with the spinning rotors of the state of the art, in particular at high rotational speeds. This is further facilitated by its smaller diameter in the area of the fiber collection groove. Nevertheless, the spinning rotor has an opening into which the extension with the fiber feeding channel and the fiber collection groove of an open end spinning device reach for example, and which is large enough so that the elements of the open-end spinning device can be made large enough so that neither the feeding of the fibers nor the withdrawal of the yarn are hindered. The size of the opening of the spinning rotor designed according to the invention, by comparison to its fiber collection groove diameter, makes it possible to use a spinning rotor with a smaller fiber collection groove than can be used in the state of the art with the same size of the extension of the open-end spinning device, so that higher rotor speeds and thereby yarn delivery speeds are possible. As a result, not only the economic advantage increases because less drive energy is used, but also the productivity of the spinning rotor is improved considerably. Furthermore the spinning rotor also has the characteristic that the wall is made with so little height that the orientation of the arriving fibers is not significantly affected by the wall of the spinning rotor. The fibers can be fed in easily thanks to its opening geometry and its low wall height near the area of the fiber collection groove, and even directly into the fiber collection groove. This has an especially favorable effect on the quality of the yarn produced. In this connection, the distance between the bottom of the spinning rotor and the plane in which the fiber collection groove is located is also especially advantageous. It makes it possible to design the withdrawal of the yarn from this spinning rotor so that the drawn-off yarn does not come into contact with the fibers being fed into the rotor. A rotor of this type tends to form less belly bandages in the yarn. A low height of the wall of less than 6.1 mm makes it possible to further increase the above-mentioned advantages, and it is here especially advantageous if the height of the wall is less than 4.1 mm, preferably between 2 mm and 6 mm, and especially advantageous if it is between 2.2 mm and 4.2 mm. In another advantageous embodiment, the fiber collection groove has a diameter between 32 mm and 30.5 mm, with the opening of the rotor having a diameter of at least 25.7 mm. In this manner, a spinning rotor that is especially efficient economically in operation can be made, which at the same time has an opening of sufficient size so that it can be supplied with fibers without problems, because the extension reaching into it can be made large enough. The fiber feeding channel can also have an advantageous size. An open-end spinning rotor is especially efficient economically in use if the diameter of the fiber collection groove is within the range of 27.5 mm and 30.5 mm. Thereby rotor speeds of much more than 130,000 rpm's are possible, so that an economically efficient rotor is created. Especially in combination with a low height of the wall of the open-end spinning rotor, a rotor can be designed which is able to produce a yarn of high quality at especially great economy. With the embodiment according to the invention, it is also possible to design rotors able to work at extraordinarily high rotor speeds, and which can still be supplied sufficiently with fibers in spite of a diameter of the fiber collection groove of less than 27.5 mm. This supply is at the same time of such quality that the fibers are fed parallel into the fiber collection groove. The invention makes it possible to provide such spinning rotors also with an opening which is large enough so that their operation may be as productive as possible, resulting in good quality of the yarn and especially high economic efficiency. Additional advantageous embodiments of the invention are described and explained in the description.

DETAILED DESCRIPTION OF THE PREFERRED EMBODIMENTS

Figure 1:
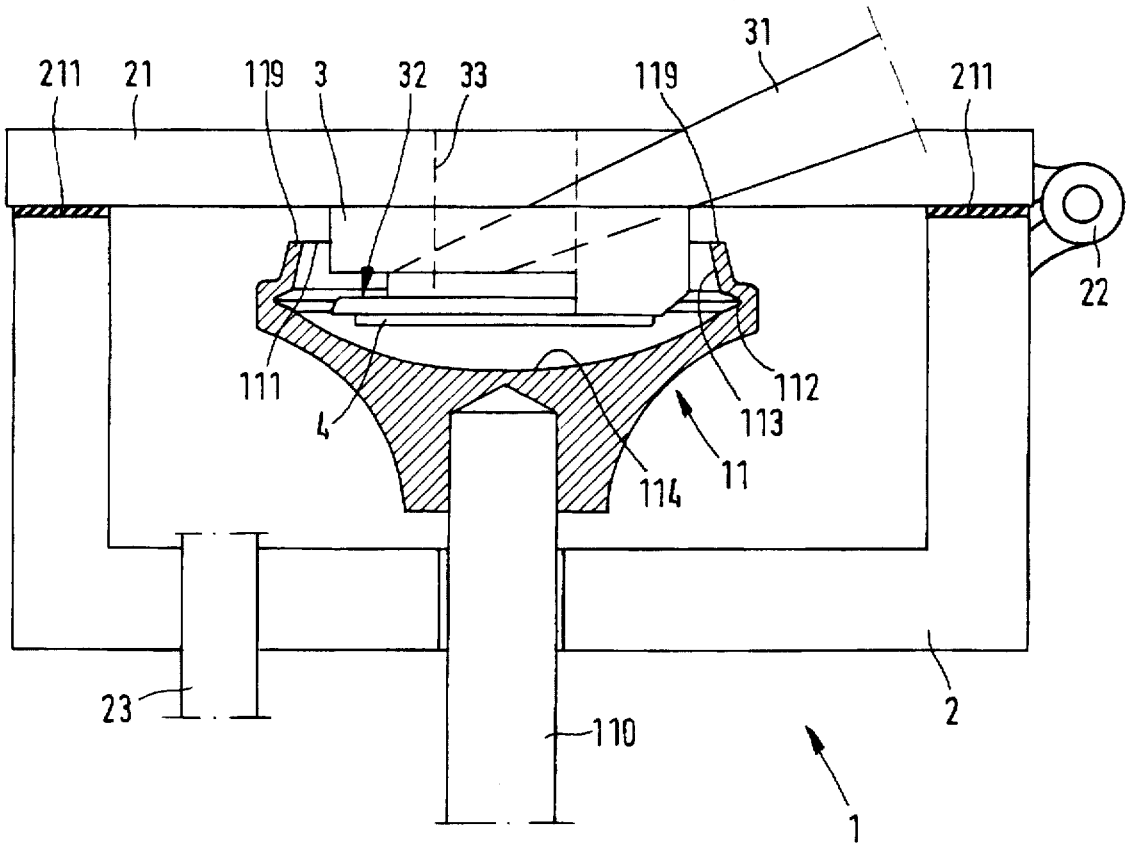
FIG. 1 illustrates an open-end spinning device according to the invention with a spinning rotor with rotor shaft.

Reference will now be made in detail to the present preferred embodiments of the invention, one or more examples of which are illustrated in the drawings. Each example is provided by way of explanation of the invention, and not as a limitation of the invention. For example, various modifications and variations can be made in the invention without departing from the scope and spirit of the invention.

The open-end spinning device 1 of FIG. 1 is equipped with a spinning rotor 11 which is supported and driven by a rotor shaft 110. The spinning rotor 11 runs inside a housing 2 which has a cover 21 which can be opened via a hinge 22 so that the housing 2 is opened. The inside of the housing 2 is subjected to negative pressure via a negative-pressure channel 23. The rotor shaft 110 penetrates through the housing 2 and the gap is very narrow in order to maintain a constant negative pressure. The cover 21 is tightly applied to the seals 211. The cover 21 has an extension 3 which extends into the interior of the spinning rotor 11. The extension 3 guides a fiber feeding channel 31 into the interior of the spinning rotor. Through channel 31, the fibers are fed into the spinning rotor in an air mixture in a known manner. The extension 3 is furthermore provided with a feed surface 32 on which the fibers leaving the fiber feeding channel 31 arrive and are separated from their conveying air. The latter leaves the spinning rotor over its edge 119 at its open end, provided with an opening 111. The extension 3 furthermore has a perforation 33 on which a yarn draw-off nozzle 4 is mounted on the inside of the spinning rotor 11. A yarn constituted in the spinning rotor 11 is withdrawn from it in a known manner through the perforation 33 and the yarn draw-off nozzle 4. The feed surface 32 of the extension 3 is constituted by a slit in the extension 3 which is essentially perpendicular to the axis of the extension 3 and is worked into it. The fiber feeding channel 31 lets out in this slit. The spinning rotor 11 has a fiber collection groove 112 on its inside as well as and a wall 113 extending between the fiber collection groove 112 and the edge 119. The extension 3 dips into the interior of the spinning rotor 11 to such depth that the plane of the feed surface 32 is at the same level as the plane of the fiber collection groove 112. The fibers fed from the fiber feeding channel 31 on the feed surface 32 glide over the latter and go essentially directly into the fiber collection groove 112. Since the distance between the yarn draw-off nozzle 4 and the rotor bottom 114 is smaller than the distance between the rotor bottom 114 and the plane of the fiber collection groove 112, the constituted yarn is withdrawn downwards from the fiber collection groove 112, i.e. in the direction of the rotor bottom 114. Thereby, the withdrawn yarn does not come into contact with the constantly newly fed fibers which pass from the feed surface 32 into the fiber collection groove 112. For the sake of clarity the distance between fiber collection groove 112 and feed surface 32 as seen in the radial direction of the spinning rotor axis has been drawn larger. In reality, the distance has preferably a value of less than 3.6 mm. With small spinning rotors, the distance is especially advantageous with a value of 1 mm to 2.8 mm. In the example of FIG. 1, the fibers are fed into the spinning rotor in the plane of the fiber collection groove, so that the fibers essentially do not come into any contact with the wall 113 of the spinning rotor 11.

According to the invention, it is however also possible for the fibers to be fed in an area of the wall 113 between the fiber collection groove 112 and the edge 119, e.g. at a distance between 1 mm and 2.8 mm from the fiber collection surface. From there the fibers go into the fiber collection groove 112 without gliding much along wall 113. The distance between the extension 3 and the wall 113 or the fiber collection groove 112 of the spinning rotor 11 may be asymmetrical so that the distance is substantially smaller on the side on which the fibers arrive into the spinning rotor than on the side away from it. As a result, the air which has entered the rotor can leave it more easily.

As FIG. 1 shows, the cover 21 is swivelled via a hinge 22 so that the end of the feed surface 32 is moved into the area of the wall 113 at the edge 119 of the spinning rotor. Thanks to the design of the spinning rotor 11 according to the invention, with a wall 113 which has a height of less than 7 mm, no special measures need to be taken in order to move the extension 3 out of the spinning rotor 11 when the cover 21 is opened, without letting the extension come into contact with the edge of the rotor.

Figure 2:
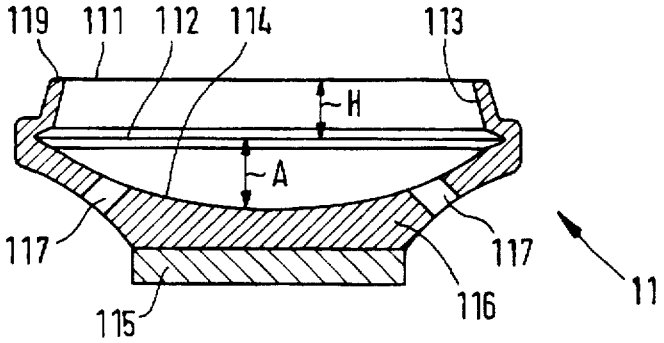
FIG. 2 illustrates a spinning rotor according to the invention with openings in the rotor bottom and with a supporting surface.

FIG. 2 shows an open-end spinning rotor 11 according to the invention. By contrast with the open-end spinning rotor of FIG. 1, the rotor of FIG. 2 has a supporting surface 115, which may be made of a material which can be magnetized and/or is especially wear-proof or self-lubricating. Thereby the spinning rotor 11 can be mounted and driven via electromagnetic forces. The basic body 116 of the spinning rotor 11 may also be made of a different material than its supporting surface 115. To produce overpressure in the interior of the spinning rotor, the latter is provided with openings 117 in its rotor bottom 114. Through openings 117, a suction effect is produced in a known manner during the operation of the spinning rotor which sucks the fibers through the fiber feeding channel into the spinning rotor. The spinning rotor of FIG. 2 according to the invention has a wall 113 which has a height H of less than 7 mm. Its diameter in the area of the fiber collection groove 112 is less than 35 mm. The opening 111, which has a circular cross-section, has a diameter that is equal to or greater than 84 % of the value of the diameter of the fiber collection groove. The rotor bottom 114 is at a distance of more than 4.5 mm from the plane of the fiber collection groove 112. The distance A does not have this value everywhere, but at least several areas of the rotor bottom 114 have this distance, advantageously including those areas of the rotor bottom 114, into which the fiber draw-off nozzle of extension 3 reaches. This distance A makes it possible to withdraw the yarn from the fiber collection groove in the direction of the rotor bottom 114 so that the fibers being fed do not come into contact with the yarn being withdrawn. The dimensions of the open-end spinning device 11 are described in the claims.

The invention is not limited to the embodiment examples shown. Thus, for example, the rotor 11 shown in FIG. 1 may have the opening 117 of the rotor 11 of FIG. 2, or the rotor 11 of FIG. 2 may not have an opening 117. The all 113 may be at different inclinations relative to the rotor axis. The wall 113 may have a height of or nearly 0 mm in a special embodiment. It will be apparent to those skilled in the art that various modifications and variations can be made in the present invention without departing from the scope and spirit of the invention. It is intended that the present invention cover such modifications and variations as come within the scope of the appended claims and their equivalents.

We claim:

1. An open-end spinning device, comprising a spinning rotor defining a fiber collection groove therein between a rotor bottom and an open end of said spinning rotor defined by an edge;

said rotor further comprising a wall extending from said fiber, collection groove to said edge;

a rotor cover having an extension reaching into the interior of said spinning rotor, said extension comprising at least a portion of a fiber feeding channel for feeding a fiber and air mixture into said rotor;

a feed surface defined in said extension adjacent said fiber feeding channel, said feed surface disposed so that fibers exiting said feeding channel are directed in substantially parallel orientation in a plane along said feed surface;

said feed surface disposed substantially radially opposite said fiber collection groove so that said fibers are fed to said fiber collection groove in their parallel orientation in said plane, said feed surface having a radial dimension so that an open radial distance of less than about 3.6 mm exists between said feed surface and said wall or fiber collection groove, said open radial distance being small enough so that fibers which travel across said open radial distance do not leave their parallel orientation;

said wall extending from said fiber collection groove to said edge having a height of generally less than 6.0 mm, said height allowing for said extension to be swiveled out of said rotor while allowing for said open radial distance of less than about 3.6 mm to said feed surface.

2. The device as in claim 1, wherein said feed surface is directly radially opposite from said fiber collection groove so that said open radial distance is less approximately 3.6 mm than between said feed surface and said fiber collection groove.

3. The device as in claim 1, wherein said feed surface is radially opposite from said wall slightly above said fiber collection groove so that said open radial distance is less than 3.6 mm between said feed surface and said wall.

4. The device as in claim 1, wherein said open radial distance is within the range of 1.0 mm to 2.8 mm.

5. The device as in claim 1, wherein said fiber collection groove comprises a diameter of less than 35 mm.

6. The device as in claim 5, wherein said fiber collection groove comprises a diameter of less than 30.5 mm.

7. The device as in claim 1, wherein said rotor further comprises a shaft.

8. The device as in claim 1, wherein said rotor further comprises a supporting surface on its side opposite said open end by which said rotor is supported and driven by electrical or magnetic forces.

9. The device as in claim 1, wherein said rotor further comprises at least one opening in said rotor bottom for producing a negative pressure inside of said rotor during spinning operations of said rotor.

10. The device as in claim 1, further comprising a perforation defined in said extension for withdrawal of yarn produced in said rotor, said perforation ending in a plane which is closer to said rotor bottom than a plane defined by said fiber collection groove.

11. The device as in claim 1, wherein said fiber collection groove has a diameter of less than 35 mm, and said open end of said rotor has a diameter which is at least 84% of the diameter of said fiber collection groove.

12. The device as in claim 11, wherein said wall has a height between 2.2 and 4.2 mm.

13. The device as in claim 11, wherein said fiber collection groove has a diameter between 30.5 mm and 32 mm and said open end of said rotor has a diameter of at least 25.7 mm.

14. The device as in claim 13, wherein said fiber collection groove has a diameter between 27.5 and 30.5 mm.

15. The device as in claim 11 wherein said rotor bottom is, at least in parts, at a distance of over 4.5 mm from a plane defined by said fiber collection groove.

16. The device as in claim 15, wherein said rotor bottom is at a distance of over 5 mm from said plane defined by said fiber collection groove.

17. The device as in claim 11, wherein said fiber collection groove has a diameter of less than 27.5 mm.

18. The device as in claim 21, wherein said feed surface is disposed essentially parallel to a plane defined by said fiber collection groove.

19. The device as in claim 1, wherein said feed surface is disposed essentially at an angle to a plane defined by said fiber collection groove.

20. An open end spinning rotor, comprising a rotor bottom and an opening opposite said rotor bottom; a fiber collection groove defined between said bottom and said opening and a wall extending from said fiber collection groove and said opening, said wall comprising a height of less than 7 mm, said fiber collection groove comprising a diameter of less than 35 mm, and said opening comprising a diameter of at least 84% of the diameter of said fiber collection groove.

21. The spinning rotor as in claim 20, wherein said wall comprises a height of less than 6.1 mm.

22. The spinning rotor as in claim 21, wherein said wall comprises a height of less than 4.1 mm.

23. The spinning rotor as in claim 21, wherein said wall comprises a height between 2 mm and 6 mm.

24. The spinning rotor as in claim 23, wherein said wall comprises a height between 2.2 mm and 4.2 mm.

25. The spinning rotor as in claim 20, wherein said fiber collection groove comprises a diameter between 30.5 mm and 32 mm and said opening comprises a diameter of at least 25.7 mm.

26. The spinning rotor as in claim 20, wherein said fiber collection groove comprises a diameter between 27.5 mm and 30.5 mm.

27. The spinning rotor as in claim 20, wherein said bottom is at least in parts at a distance of over 4.5 mm from a plane defined by said fiber collection groove.

28. The spinning rotor as in claim 27, wherein said bottom is at a distance of over 5 mm from said plane.

29. The spinning rotor as in claim 20, wherein said fiber collection groove has a diameter of less than 27.5 mm.

* * * * *

UNITED STATES PATENT AND TRADEMARK OFFICE

CERTIFICATE OF CORRECTION

PATENT NO : 5,755,087

DATED : MAY 26, 1998

INVENTOR(S) : WERNER BILLNER ET AL.

It is certified that error appears in the above-identified patent and that said Letters Patent is hereby corrected as shown below:

Claim 2, column 8, line 22, insert --than-- after "less"; and line 23, delete "than".

Signed and Sealed this

Twenty-second Day of August, 2000

*Attest:*

Q. TODD DICKINSON

*Attesting Officer*

*Director of Patents and Trademarks*